United States Patent [19]

Sato et al.

[11] 4,368,504

[45] Jan. 11, 1983

[54] TASK LIGHTING APPARATUS

[75] Inventors: Kozi Sato, Yokohama; Tadahiro Kaneko, Tokyo, both of Japan

[73] Assignee: Toshiba Electric Equipment Corporation, Tokyo, Japan

[21] Appl. No.: 304,608

[22] Filed: Sep. 22, 1981

[30] Foreign Application Priority Data

Sep. 22, 1981 [JP] Japan ..... 56-131868

[51] Int. Cl.[3] ..... A61G 13/00

[52] U.S. Cl. ..... 362/33; 362/223; 362/224; 362/290; 362/292; 362/309; 362/311; 362/330; 362/332; 362/339; 362/375

[58] Field of Search ..... 362/33, 223, 224, 290, 362/292, 309, 311, 330, 332, 339, 375

[56] References Cited

U.S. PATENT DOCUMENTS 4,233,651 11/1980 Fabbri ..... 362/33

4,242,723 12/1980 Fabbri et al. ..... 362/33

4,300,185 11/1981 Wakamatsu ..... 362/33

*Primary Examiner*—Stephen J. Lechert, Jr.

*Attorney, Agent, or Firm*—Oblon, Fisher, Spivak, McClelland & Maier

[57] ABSTRACT

A light source consisting of a straight tube fluorescent lamp is mounted almost in parallel with a desk work surface to be illuminated. A housing enclosing this light source is mounted, and this housing is fixed on the surface to be illuminated by means of two support members. The housing has an opening section at its lower position, and a light controller which is formed of two kinds of prism plates is fitted in the opening. The light emitted from the light source is refracted by the prism plates. These beams of light are converted by the above light controller to two types of light components which run almost in parallel with the first and second directions. One of the beams of light falls from the right top in front of the person at desk to the illuminated surface region in proximity to the left hand of the person at desk, and the other beams of light fall from the left top in front of the person at desk to the illuminated surface region in proximity to the right hand of the person at desk.

13 Claims, 12 Drawing Figures

TASK LIGHTING APPARATUS

BACKGROUND OF THE INVENTION

This invention relates to a lighting apparatus, and particularly to a task lighting apparatus which illuminates surface such as the work surface of an office desk.

In conventional device, reflector at the back of light source, for example, straight tube fluorescent lamp is provided to illuminate surface to be illuminated, for example, the ceiling board (work surface) of an office desk in almost even illumination. The beam emitted from the fluorescent lamp is turned by the reflector to the region of the ceiling board near the person at desk. This improves the distribution of illuminance in the region of the ceiling board corresponding to the region near the hands of the person at desk. However, the light emitted from the task lighting apparatus reflects diametrically in the region of the ceiling board situated in front of the person at desk to produce undesirable reflection, so-called veiling reflection.

In order to prevent this veiling reflection, a task lighting apparatus as illustrated in FIGS. 1 to 3 has been developed. A light source, for example, straight tube fluorescent lamp 10 is provided on the ceiling board (work surface) 12 of the office desk 14 as shown in FIG. 1. This fluorescent lamp 10 is held in a housing 16. This housing 16 is fixed to the office desk 14 by means of the support members 18. This housing 16 has at least one opening at its lower position. This opening is provided with a light-transmitting plate 20 shown in FIG. 2. A plurality of V-shape grooves 22 are formed on the face where this light-transmitting plate is opposite to the fluorescent lamp 10. These V-shape grooves 22 are provided in the direction of the tube axis of the fluorescent lamp 10 and are in parallel with one another. When the light emitted from the light source 10 of the fluorescent lamp falls on the light-transmitting plate 20, it is split to two directions shown by the arrows 24, 26, respectively. That is, the V-shape grooves 22 formed on the light-transmitting plate 20 functions as prisms. Therefore, the beam illuminating the work surface 12 of the office desk 14, as shown in FIG. 1, radiates in the directions 24, 26 on the plane almost perpendicular to the work surface 12 and including the tube axis of the straight tube fluorescent lamp 10. In other words, so-called twin beam distribution is formed. As a result, the above-mentioned veiling reflection can be prevented. However, this has a disadvantage that only the region just under the lighting device of the work surface 12 is illuminated in brightness but the whole work surface is not evenly illuminated. Further, this has another disadvantage that the fatigue of the eyes of the person at desk is undesirably on the increase, because the region of the work surface on the side of the hand of the person at desk gets dark.

SUMMARY OF THE INVENTION

The object of the invention is to provide a task lighting apparatus for preventing veiling reflection and illuminating the work surface in even brightness.

The task lighting apparatus of this invention includes a light source installed opposite to a work surface to be illuminated. The light source is positioned at intervals of a prescribed distance from the work surface, and has at least a straight tube section. An elongated housing is provided to enclose the light source and has at least an opening at a position opposite to the work surface. A light-control means is provided at the opening of the housing to refract most of the beams of light emitted from the light source at least in first and second directions and control the light from the light source so as to maintain the maximum illuminance in the first and second directions. The first direction is set in a direction parallel with a first line which is included in a plane including a central axis of the straight tube section of the light source and forming a prescribed vertical angle against the work surface. The first line extends from one of two edge portions of the straight tube section, which are opposite to each other in a longitudinal direction along the central axis of the straight tube section. The first line is so set as to form a first angle against the central axis of the straight tube section of the light source. On the other hand, the second direction is set in a direction parallel with a second line which is also included in the above-mentioned plane, crosses the first line, extends from the other edge portion of the straight tube section of the light source, and forms a second angle against the central axis of the light source straight tube section.

DETAILED DESCRIPTION OF THE PREFERRED EMBODIMENTS

Figure 1:
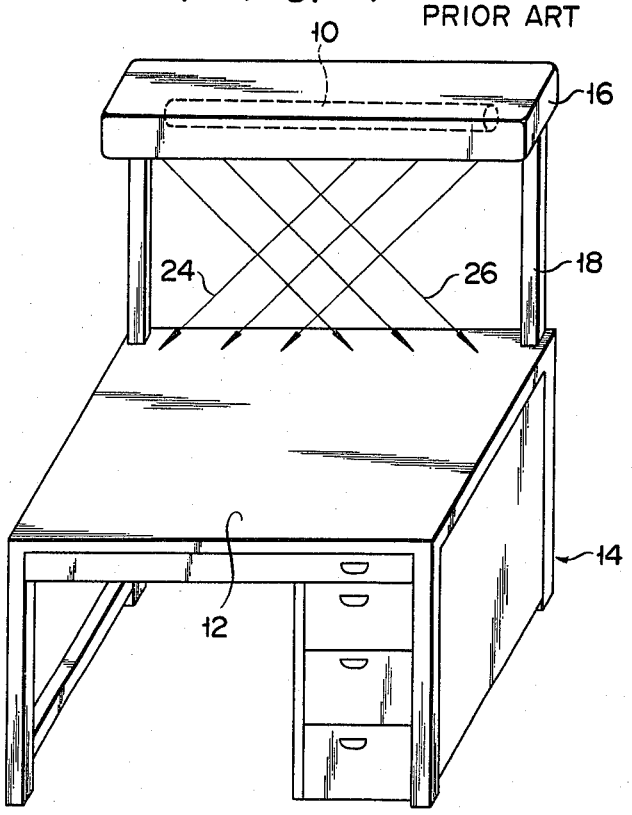
FIG. 1 PRIOR ART
FIG. 1 is a perspective view of an office desk with a conventional task lighting apparatus.
Figure 2:
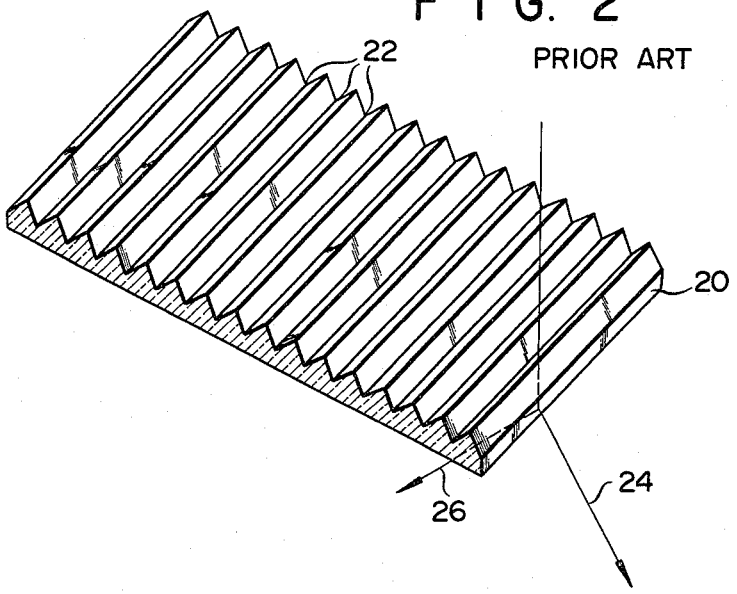
FIG. 2 PRIOR ART
FIG. 2 is a perspective view of a light-transmitting plate mounted on the opening at the lower position of the housing of the conventional apparatus shown in FIG. 1.
Figure 3:
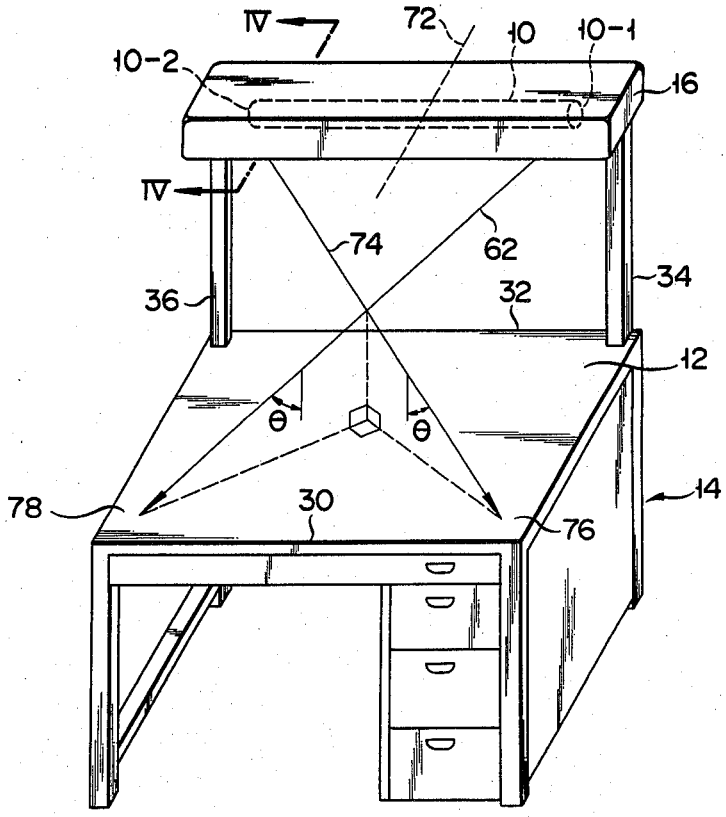
FIG. 3 is a perspective view of an office desk with the task lighting apparatus which is the first embodiment of the invention.

The first embodiment of this invention is illustrated in FIG. 3. The light source 10 is provided above the ceiling board 12 of the office desk 14 and are almost in parallel with this ceiling board 12. The light source 10, for example, consists of a straight tube fluorescent lamp. The ceiling board 12 is formed in a rectangle and has a first desk edge 30 in close proximity of the person at desk, and a second desk edge 32 opposite to the first desk edge 30. The above-mentioned straight tube light source 10 is situated almost in parallel with these first and second desk edges 30, 32 and above the second desk edge 32 of the ceiling board 12. The housing 16 enclosing this straight tube light source 10 is provided, and this housing 16 is formed in a slender shape, corresponding to the length of the straight tube light source 10. This housing 16 is separated from the ceiling board (work surface) at a prescribed distance by a plurality of support members, for example, two support members 34, 36, and mounted and fixed on the office desk 14.

Figure 4:
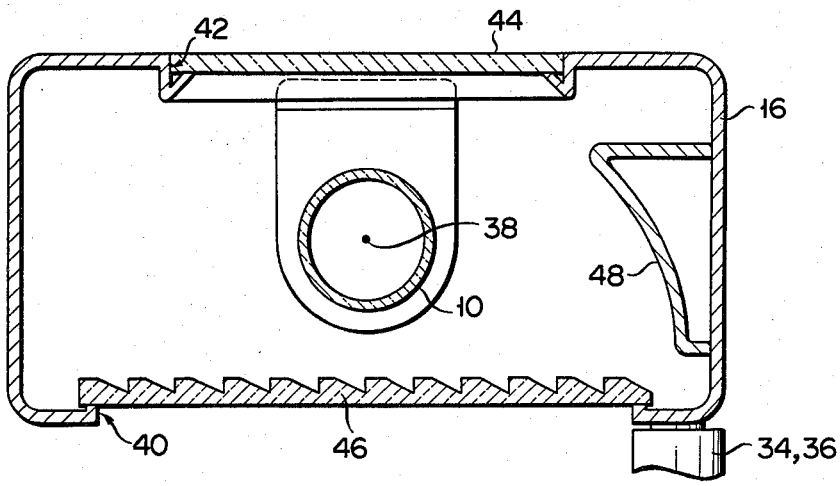
FIG. 4 is a section view on line of IV—IV of the housing of the task lighting apparatus which is the first embodiment of the invention illustrated in FIG. 3.

A section structure of the task lighting apparatus on line of IV—IV shown in FIG. 3 is illustrated in FIG. 4. The straight tube light source 10 has its central axis 38. In the position where the housing 16 is opposite to the work surface 12, an opening 40 is formed. The opening 40 at the lower position is formed, corresponding to the length of the straight tube light source 10. Another opening 42 is provided on the opposite side of the lower opening 40 of the housing 16. This opening 42 at the upper position is provided with a light-transmitting plate made of light-transmitting material, for example plastic plate. On the other hand, the opening 40 at the lower position is provided with a refractor member made from light-transmitting material, for example, refractive plate 46. Further, a known auxiliary reflector 48 is provided at the back of the straight tube light source 10.

Figure 5:
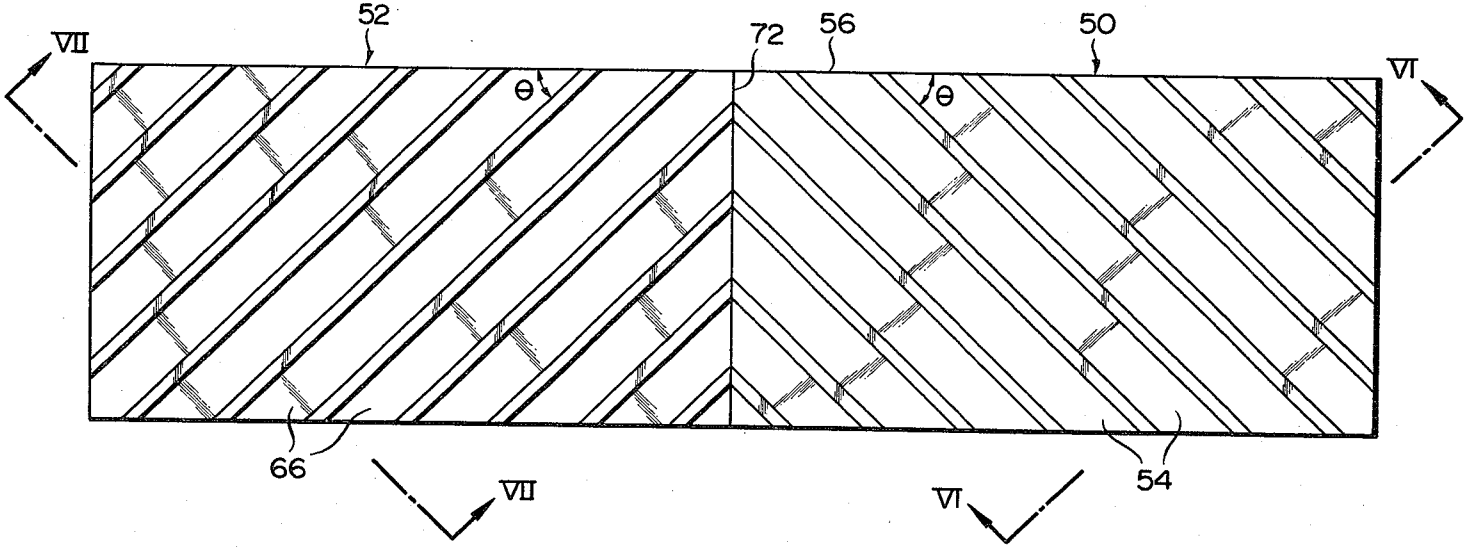
FIG. 5 is a plan view of the refractive plate mounted on the opening at the lower position of the housing illustrated in FIG. 4.
Figure 6:
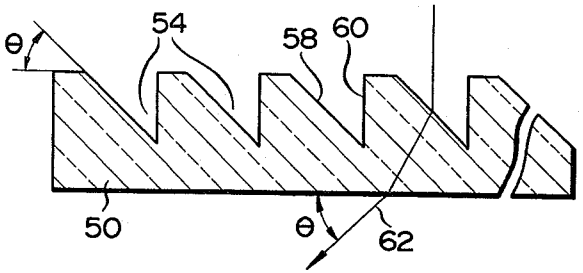
FIGS. 6 and 7 are section views on line of VI—VI, and on line of VII—VII of the refractive plate illustrated in FIG. 5.

FIG. 5 is a plan view of the refractive plate 46 shown in FIG. 4. This refractive plate 46 consists of two plate sections 50, 52 each having the same size. These plate sections 50, 52 are formed, for example, in one united body with each other, and are provided almost in parallel with the desk work surface 12. In FIG. 5, on the surface of the plate section 50 is formed V-shape grooves 54 running from the left top to the right bottom. These V-shape grooves are provided in parallel with one another. These grooves 54 forms an inclination angle with the edge line 56 of the refractive plate 46, and this inclination angle $\theta$ is preferably selected at approx. 40°. FIG. 6 shows a section structure on line of VI—VI. One wall face 58 of each of the V-shape grooves 54, for example, is inclined by an angle equal to the above-mentioned angle $\theta$ against the surface of the plate section 50 which is in parallel with the desk work surface to be illuminated, and the other wall face 60 is formed at a right angle to the above-mentioned surface. Therefore, when the light emitted from the light source 10 falls on one wall face 58 of each groove is refracted by this plate section 50, and runs along the direction indicated by the arrow 62. The angle of emergence of the light from the plate section 50 becomes equal to the angle $\theta$. In other words, this plate section 50 functions as a prism to refract the direction of the light which falls on the plate section 50.

Figure 7:
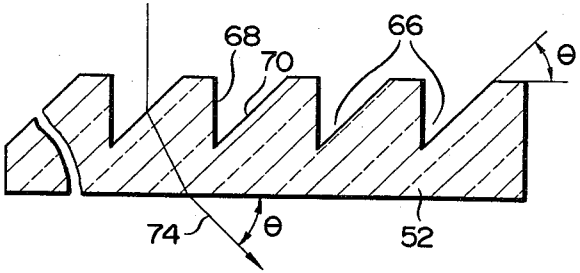

Again with reference to FIG. 5, another plate section 52 of the two plate sections which form the refractive plate 46 has V-shape grooves 66 on one wall face. In the figure, these grooves 66 are provided from the right top to the left bottom and are formed so as to be inclined by the same angle to the edge line 56 of the refractive plate 46. In other words, these grooves 66 are formed so as to be crossed at right angles with the grooves 54. The cross section of this plate section 52 on line of VII—VII is shown in FIG. 7. One wall face 68 of each of the V-shaped grooves 66 is formed at a right angle to the surface of the plate section 52, and another wall face 70 is inclined, for example, by an angle almost equal to the angle $\theta$ to the surface. In short, these plate members 50, 52 are constituted in a symmetrical shape to the separation line 72. When the light emitted from the light source 10 falls on the inclined wall face 70 of this plate section 52, the light is refracted in the same mode as mentioned above. In this case, however, the light refracts and runs in the direction indicated by the arrow 74, and emerges from this plate section at an angle of emergence $\theta$. The direction indicated by the arrow 74 becomes symmetrical with the path of light indicated by the arrow 62. Therefore, this plate section 52 may be regarded as a prism.

The light which has been transmitted through the refractive plate 46 consisting of these prism plates 50, 52 is radiated in parallel with the directions indicated by the same reference numerals 62, 74 shown in FIG. 3. The light refracted and emitted by the prism plate 50 is radiated in the direction indicated by the arrow 62 and illuminates one edge region 78 of the desk work surface 12. This edge region 78 corresponds to the region adjacent to the left hand of the person who sits at the desk 14. The direction of the first light radiation indicated by the arrow 62 extends from the first edge portion 10-1 of the light source 10, includes the central axis 38 of the straight tube light source 10, and forms an angle equal to the above-mentioned angle with the vertical plane (not shown) which is included in the oblique plane (not shown) which crosses the desk work surface at a vertical angle equal to the above-mentioned angle $\theta$ and includes the central axis 38 of the straight tube light source. On the contrary, the light refracted and emitted by the prism plate 52 radiates in parallel with the direction of the arrow 74 and illuminates the other edge region 76 of the work surface 12. This edge region 76 corresponds to the region adjacent to the right hand of the person who sits at the desk 14. The direction of the second light radiation indicated by the arrow 74 extends from the edge portion 10-2 of the straight tube light source, is included in the above-mentioned oblique plane, forms an angle equal to the angle $\theta$ with the above-mentioned vertical plane, and is planned so as to cross diagonally. This angle $\theta$ is selected at approx. 45° as mentioned above, the first and second directions cross each other at a right angle in the oblique plane. Additionally, the first direction 62 is at a right angle with the V-shape grooves 54 formed on the prism plate 50 (FIG. 5) of the refractive plate 46. The second direction 74 is at a right angle to the V-shape grooves 66 of the other prism plate 52 mentioned above. Additionally, in other words, these first and second directions include the line 72 separating the two prism plates 50, 52, and are symmetrical to each face on the plane (not shown) vertical to the work surface 12. Further, the term "vertical angle" represents an angle which crosses a voluntary line crossing the surface to be illuminated and forms a vertical line to the surface to be illuminated.

According to the task lighting apparatus constituted as mentioned above, which is the first embodiment of the invention, most of the beams of light emitted from the light source 10 falls on the refractive plate 46 mounted on the lower opening 40 at the lower position of the housing 16. At the same time, some of the beams of ligth emitted from the light source 10 reflects at the auxiliary reflector 48 mounted within the housing 16 and falls on the refractive plate 46. These beams of light are refracted by two prism plates 50, 52 which constitute the refractive plate 46 and are symmetrical to each line at the separation line 72. The light refracted by the oblique face 58 of the V-shape grooves 54 formed by the prism plate 50 runs almost in parallel with the first direction indicated by the arrow 62 and illuminates the edge region 78 of the work surface 12 adjacent to the person who sits at the desk 14. The light refracted by the oblique face 70 of the V-shaped grooves 66 formed by the prism plate 52 radiates almost in parallel with the second direction indicated by the arrow 74 and illuminates the neighbourhood of the edge region 76 of the desk work surface 12. Therefore, as a whole, the amount of light which falls on the region adjacent to the first edge 30 of the work surface to be illuminated 12 (the ceiling board) of the desk 14 increases. Therefore, the brightness is improved in the region on the side of the hand of the person sitting at the desk 14 as well as the region adjacent to the second edge 32 of the desk work surface 12 just below the light source 10. This makes it possible to maintain even brightness on the whole surface to be illuminated of the office desk 14. Thus, this also makes it possible to reduce the fatigue of the eyes of the person at desk.

Figure 8:
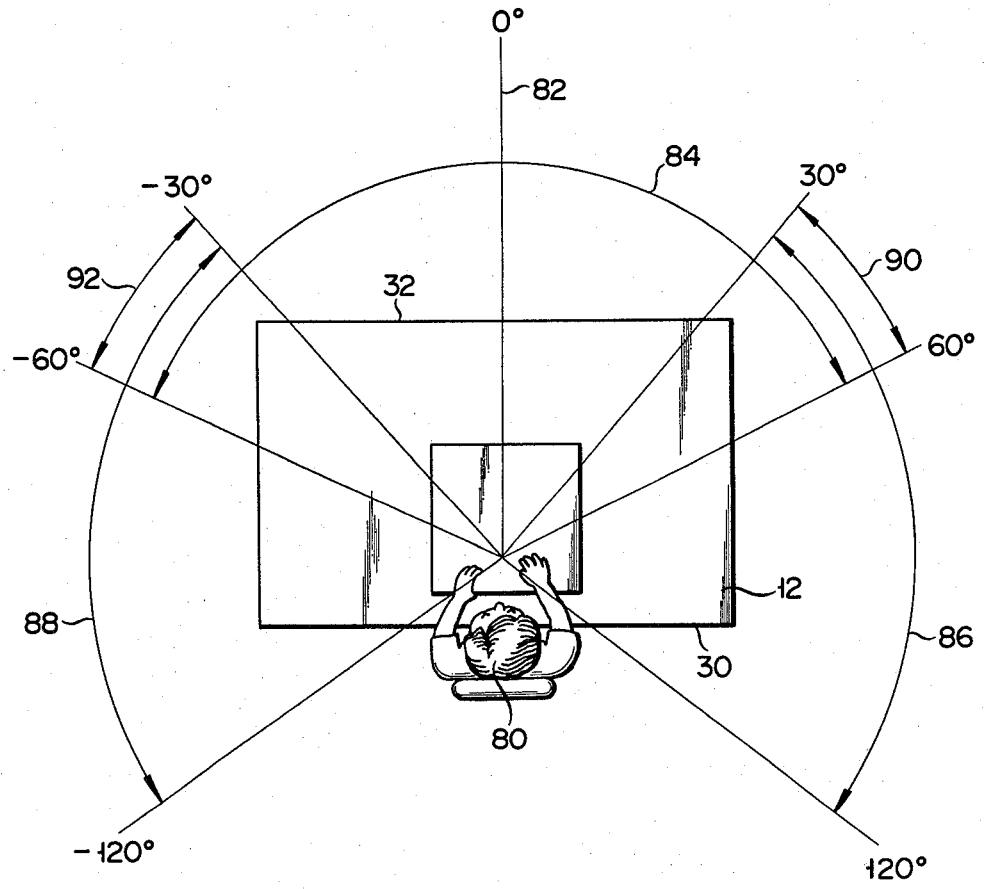
FIG. 8 is a figure to describe the incident angle of the light emitted from the task lighting apparatus of this invention to the person at desk.
Figure 9:
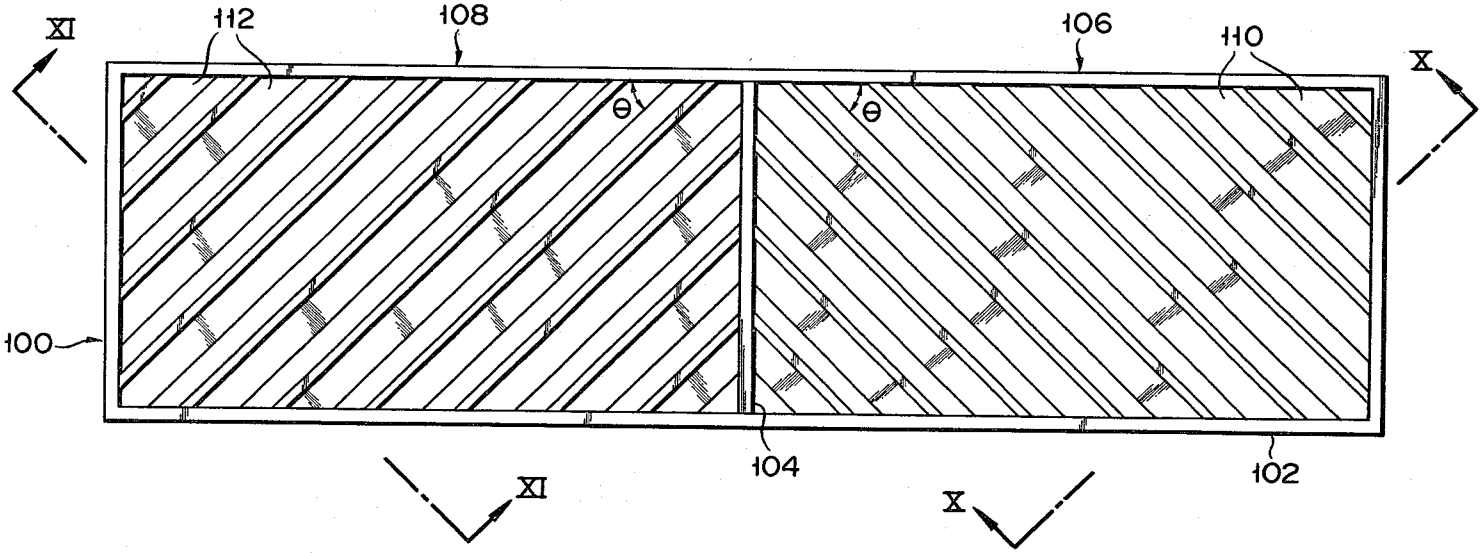
FIG. 9 is a plan view of the refractor member mounted at the lower position of the opening of the housing provided to the task lighting apparatus which is the second embodiment of the invention.

With reference to FIG. 8, the effects of this invention are described more detailedly. In order to increase brightness on the region adjacent to the hand of the person 80 at desk and carry out even illumination, it is preferable that the light falls on each of the right and left separated from the basic line 82 perpendicular to the person 80 sitting at the desk, from the range of angle 84 at 60°. As mentioned above, however, the light undergoing specular reflection on the work surface in the range of angle 84 causes a veiling reflection which is undesirable to the person 80 at desk. In order to prevent this veiling reflection, it is desirable that the light falls from the right and left sides to the persons 80 sitting at the desk, as indicated by the arrows 86, 88. However, when the direction from which the light falls is too much inclined to the side direction, the illumination in the region of the surface to be illuminated in close proximity of the hand of the person 80 at desk will be reduced by the shadow of the person 80 at desk. According to this invention, the inclination angle $\theta$ of the oblique faces 58, 70 of the V-shape grooves 54, 66 formed on the prism plates 50, 52 respectively is set at approx. 45° with the central axis 38 of the straight tube light source 10 as mentioned above. Therefore, the light refracted by these prism plates 50, 52 substantially falls from the range of angle indicated by the arrows 90, 92 in FIG. 8. As a result, the deterioration of uniformity of illuminance on the desk work surface 12 is prevented, and at the same time, the undesirable veiling reflection is prevented from occurring. Therefore, this ensures the reduction of the fatigue of the eyes of the person at desk. As a result, the improvement of the work of the person at desk can be promoted.

Figure 10:
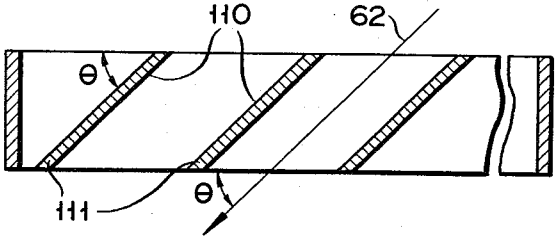
FIGS. 10 and 11 are section views on line X—X and on line of XI—XI of the refractor members of FIG. 9, respectively.

FIGS. 9 to 12 inclusive shows the second embodiments of this invention. However, as the same reference numerals are attached to the same sections, the detailed description is omitted. The lower opening 40 at the lower position of the housing 16 is provided with a light controller 100 consisting of a louver shown in FIG. 9. The louver 100 has a frame 102 corresponding to the dimensions of the louver opening 40 at the lower position of the housing 16. A partition plate 104 is fixed at the almost central section of this frame 102. The frame 102 is divided by this partition plate to the louver sections 106, 108 each having an almost equal area. One louver section 106 is provided with a plurality of thin plates 110 in parallel with one another. These thin plates 110 (called blade plates) are provided at an incline of a prescribed angle with the frame 102 from the left top to the right bottom as illustrated. It is preferable that this prescribed angle is set at the angle $\theta$ (=45°). The section structure of the louver section 106 on line of X—X is shown in FIG. 10. The blade plates 110 of this louver section 106 are inclined by a prescribed angle with the perpendicular direction so that the lower edge 111 of these thin blades 110 can approach the partition board 104. It is preferable that this prescribed angle is set at the angle $\theta$ (=45°). Therefore, the beams of light which substantially run in parallel with the oblique faces of the blade plates 110 of the louver section 106, out of the light beams emitted from the light source, are allowed to pass this louver 106. These beams of light run in parallel with the direction indicated by the arrow 62. It is clear that this direction 62 is the one in which the first light runs, as shown in FIG. 3. The rest of the beams emitted from the light source 10 is reflected or inhibited to pass by the blade plates 110 of the louver section 106, so that it can be decreased or cut off. In other words, the louver section 106 of the task lighting apparatus in the second embodiment of this invention substantially emits exclusively the light having the direction of running almost in parallel with the first direction 62.

Figure 11:
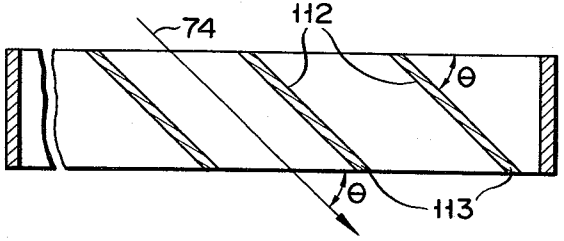

The other louver section 108 of this light controller member (louver) 100 has a plurality of blade plates 112 which are in parallel with each other. However, these blade plates 112 extend from the right top to the left bottom, on the contrary to the blade plates 110 of the louver section 106 as illustrated. The section structure of this louver section 108 on line of XI—XI is shown in FIG. 11. These blade plates 112 are further inclined by a required angle toward the perpendicular direction so that the lower position 113 of these blade plates 112 can approach the partition board 104. It is preferable that this required angle is set at the same angle $\theta$ (=45°). Therefore, the beams of light which run in parallel with the oblique faces of the blade plates 112 of the louver section 108, out of the light beams emitted from the light source 10, are allowed to pass this louver section 108. These beams of light substantially run in parallel with the direction indicated by the arrow 74. This direction 74 is naturally the one in which the second light runs, as shown in FIG. 3. As a result, this louver section 108 substantially emits exclusively the light which runs almost in parallel with the second direction 74.

Figure 12:
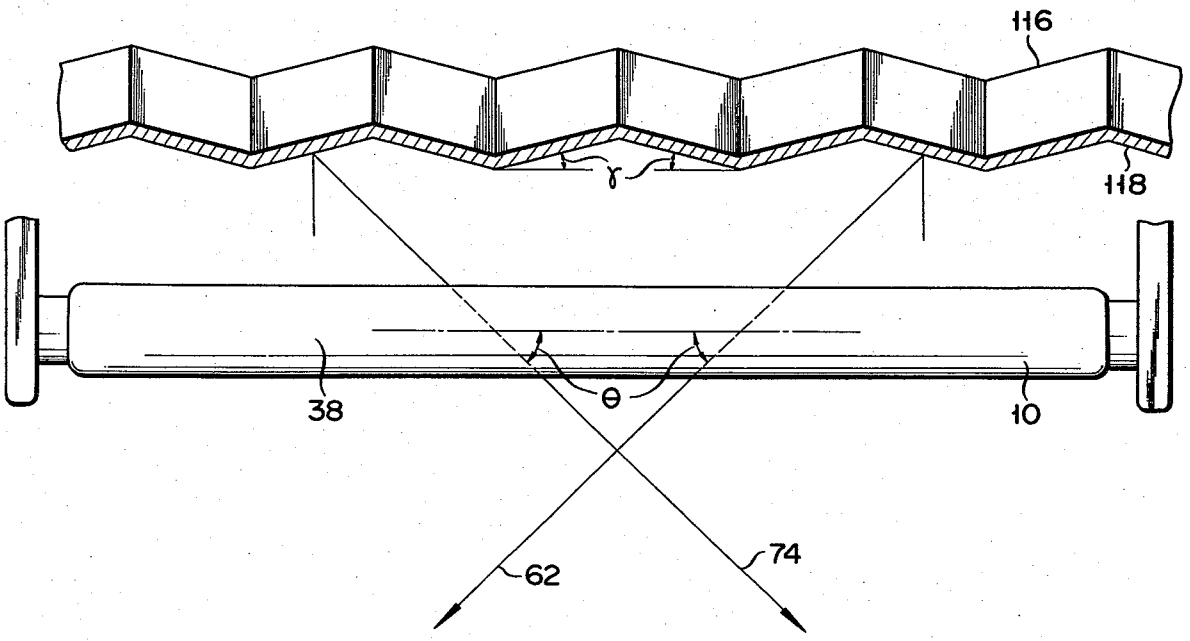
FIG. 12 is a figure to illustrate the positions of the light source and the reflector additionally provided to the second embodiment of the invention shown in FIG. 9.

A reflector plate provided in close proximity to the straight tube light source 10 within the housing 16 in this second embodiment is shown in FIG. 12. This reflector plate 116 is formed being bended in zigzags in the direction of the central axis 38 of the straight tube light source 10. Each oblique face of this reflection plate 116 is inclined by a required angle $\gamma$ against the direction of the central axis 38 of the straight tube light source 10. This angle $\gamma$ is preferably set within the range of 20° to 25°. Therefore, the beams of light emitted from the light source 10 and fallen on the reflection plate 116 are reflected by the reflection face 118 of the reflector plate 116 and run in the first and second directions indicated by the arrows 62, 74, respectively. After it has been reflected, the light passes the louver sections 106, 108 of the light controller member 100 shown in FIG. 9.

According to the task lighting apparatus constituted as mentioned above in the second embodiment of this invention, the light emitted from the light source 10 and directly fallen to the light controller member 100 consisting of the louver sections 106, 108 is converted by this light controller member 100 to the light having beam elements which run almost in parallel with the first and second directions 62, 74. On the other hand, the light emitted from the light source 10, reflected from the zigzag reflector 116, and fallen on the light controller member 100 is converted to the light elements having the same angle as the oblique angles of the blade plates 110, 112 of the louver sections 106, 108 substantially constituting this light controller member 100. Therefore, these beam elements likewise pass the louver sections 106, 108. In other words, out of the beams of light emitted from the light source 10 in various directions, some is run by this light controller member 100 and the zigzag reflector 116 almost in parallel with the first and second directions indicated by FIG. 3, and the other is decreased or cut off. Both edge regions 78, 76 of the desk work surface 12 are illuminated by the beams of light which substantially run in parallel with the first and second directions 62, 74. Thus, the illumination for the regions of the work surface 12 adjacent to the person at desk, as a whole, can be improved, with result that the uniformity of illuminance on the surface to be illuminated, as a whole, can be equalized. Further, for the same reason as mentioned above, undesirable veiling reflection can be prevented. Thus, the fatigue of the eyes of the person sitting at the desk 14 can be reduced, and the performance of the work of the person at desk can be improved.

Although the present invention has been shown and described with respect to particular embodiments, nevertheless, various changes and modifications which are obvious to a person skilled in the art to which the invention pertains are deemed to lie within the spirit, scope, and contemplation of the invention. In the first and second embodiments mentioned above, the prism plates 50, 52 and the louver sections 106, 108 are respectively provided in order to control the light emitted from the light source 10 in the prescribed directions. It is natural, however, that other optical members can be applied for this invention, if they have the above-mentioned functions, irrespective of the above members. On the other hand, the straight tube fluorescent lamps is employed as the light source 10, but irrespective of this type of fluorescent lamp, a lamp which extends in the longish direction, such as U-shape lamp and S-shape lamp, may be employed as a light source. Further, one wall face of each of the V-shape grooves formed in the refractive plate 46 in the first embodiment is vertical, but irrespective of this, both wall faces may be oblique. Further, in the second embodiment, the light controller member 100 consisting of the louver sections 106, 108, and the zigzag reflector 116 are provided within the housing 16. However, if either of the light controller 100 or the reflector 116 is provided within the housing 16, it will not greatly damage the effects of this invention. In this case, the manufacturing costs will be reduced.

Further, in the first and second embodiments, the angle $\theta$ is set at 45°, but if the angle is set at 45°±10°, or 35° to 55°, depending on the situation, the substantially same effects can be obtained. This is because if the angle $\theta$ is less than 35°, the uniformity of illuminance is damaged, and if greater than 55°, the ability to prevent the veiling reflection is reduced, with the result that the effects of the invention can be not be drawn out.

We claim:

1. A task lighting apparatus comprising:

(a) a light source installed opposite to a work surface to be illuminated and at intervals of a prescribed distance from the work surface, and including at least a straight tube section which has a central axis and at least a first edge portion and a second edge portion opposite to each other in the longitudinal direction along the central axis;

(b) an elongated housing provided to enclose said light source and having at least an opening at a position opposite to the work surface; and (c) light-control means provided at the opening of said housing to control most of the beams of light emitted from said light source at least in first and second directions and control the light from said light source so as to maintain the maximum intensity in the first and second directions, said first direction being set in a direction substantially parallel with a first line which is included in a plane including the central axis of the straight tube section of said light source and forming a prescribed vertical angle against the work surface, extends from the first edge portion of the straight tube section, and forms a first angle against the central axis of the straight tube section; and said second direction being set in a direction substantially parallel with a second line which is also included in said plane, crosses the first line, extends from the second edge portion of the straight tube section of said light source, and forms a second angle against the central axis of the straight tube section.

2. A task lighting apparatus according to claim 1, wherein said vertical angle of said plane, and said first and second angles formed by the first and second lines and the central axis of the straight tube section of said light source are set at the substantially same angle with each other, within the range of 35° to 55°.

3. A task lighting apparatus according to claim 2, wherein said vertical angle and said first and second angles are preferably set at approx. 45°, the first and second lines crossing at a right angle within said plane.

4. A task lighting apparatus according to claim 1, wherein the work surface to be illuminated is a surface of ceiling board of a desk.

5. A task lighting apparatus according to claim 1, wherein said light source includes a straight tube fluorescent lamp.

6. A task lighting apparatus according to claim 1, wherein said light control means includes a light-control plate made of light-transmitting material and having at least two prism sections;

one of the prism sections is provided in an opening region almost one half the opening of said housing provided opposite to the work surface to be illuminated, and includes a plurality of first grooves parallel with one another, extending in a third direction crossing the first direction at an almost right angle, and having V-shape cross-sections; and the other prism section is provided in the other opening region of the opening of said housing, and includes a plurality of second grooves parallel with one another, extending in a fourth direction crossing the second direction at an almost right angle, and having V-shape cross-sections.

7. A task lighting apparatus according to claim 6, wherein each of the first and second grooves formed respectively on the surfaces of said two prism sections has two wall faces, one of the wall faces being formed at an almost right angle.

8. A task lighting apparatus according to claim 6, wherein said first and second grooves cross each other at a right angle.

9. A task lighting apparatus according to claim 1, wherein said light control means includes the louver means allowing the passage of light components which are emitted from said light source provided in said housing having opening, and have directions almost in parallel with said first and second directions.

10. A task lighting apparatus according to claim 9, wherein said louver means of said light-control means includes at least two louver sections;

one of said louver sections is provided in an opening region almost one half the opening of said housing, and includes a plurality of first blade members which extend in a third direction crossing the first direction at an almost right angle, are in parallel with one another, and each include at least edge portions opposite to the work surface, said first blade members being inclined so that the edge portion of each of said first blade members is located with respect to a central point of the straight tube section of said light source; and the other louver section is provided in the other opening region of the opening of said housing, and includes a plurality of second blade members which extend in a fourth direction crossing the second direction at an almost right angle, are in parallel with one another, and each include at least edge portions opposite to the work surface, said second blade members being inclined so that the edge portion of each of said second blade members is located with respect to the central point of the straight tube section of said light source.

11. A task lighting apparatus according to claim 10, wherein said first and second blade members are inclined so as to be almost in parallel with said first and second directions.

12. A task lighting apparatus according to claim 10, wherein said louver means further comprises reflecting plate means provided in close proximity to the straight tube section of said light source, formed being bended in zigzags at a prescribed angle, and spliting and reflecting the light falling from said light source in the direction almost in parallel with said first and second directions.

13. A task lighting apparatus according to claim 1, wherein the work surface to be illuminated is a surface of ceiling board of a desk, the ceiling board having at least the first edge portion in proximity to a person at desk and the second edge portion opposite to the first edge portion, and said light source being installed above said second edge of the ceiling board.

* * * * *

UNITED STATES PATENT AND TRADEMARK OFFICE

CERTIFICATE OF CORRECTION

PATENT NO. : 4,368,504

DATED : January 11, 1983

INVENTOR(S) : Kozi Sato et al.

It is certified that error appears in the above-identified patent and that said Letters Patent is hereby corrected as shown below:

On the title page, the Foreign Application Priority Data should read as follows.

[30] -- Foreign Application Priority Data

Sep. 22, 1980 [JP] Japan...56-131868 --

Signed and Sealed this

Fifth Day of April 1983

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,368,504

DATED : January 11, 1983

INVENTOR(S) : KOZI SATO et al.

It is certified that error appears in the above-identified patent and that said Letters Patent is hereby corrected as shown below:

On the title page:

Please correct the following Foreign Application Priority data:

[30] -- Foreign Application Priority Data

Sept. 22, 1980 [JP] Japan.....55-131868 --

This certificate supersedes certificate of correction issued April 5, 1983.

Signed and Sealed this

Fourteenth Day of June 1983

[SEAL]

*Attest:*

DONALD J. QUIGG

*Attesting Officer*

*Acting Commissioner of Patents and Trademarks*